US007972173B1

(12) United States Patent
Hyzin et al.

(10) Patent No.: US 7,972,173 B1
(45) Date of Patent: Jul. 5, 2011

(54) DUAL SPRING PROBE COAXIAL CONTACT SYSTEM

(75) Inventors: Peter J. Hyzin, Coto de Caza, CA (US); Michael Santos Finona, Lake Forrest, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 12/800,059

(22) Filed: May 7, 2010

(51) Int. Cl.
*H01R 9/05* (2006.01)

(52) U.S. Cl. ..... 439/578; 439/700; 439/824

(58) Field of Classification Search ..... 439/578, 439/700, 824, 289
See application file for complete search history.

(56) References Cited

U.S. PATENT DOCUMENTS

| | | | | | |
|---|---|---|---|---|---|
| 3,275,970 | A * | 9/1966 | Johanson et al. | ..... | 439/578 |
| 3,416,125 | A * | 12/1968 | Theve | ..... | 439/638 |
| 3,609,637 | A * | 9/1971 | Cole | ..... | 439/349 |
| 4,734,050 | A * | 3/1988 | Negre et al. | ..... | 439/289 |
| 4,740,746 | A * | 4/1988 | Pollock et al. | ..... | 324/754.06 |
| 5,329,262 | A | 7/1994 | Fisher, Jr. | ..... | 333/33 |
| 6,053,777 | A * | 4/2000 | Boyle | ..... | 439/700 |
| 6,758,680 | B2 * | 7/2004 | Duquerroy et al. | ..... | 439/63 |
| 6,776,668 | B1 * | 8/2004 | Scyoc et al. | ..... | 439/700 |
| 7,189,113 | B2 | 3/2007 | Sattele et al. | ..... | 439/578 |
| 7,238,047 | B2 | 7/2007 | Saettele et al. | ..... | 439/578 |
| 7,399,208 | B2 | 7/2008 | Schmidt | ..... | 439/578 |
| 7,416,418 | B2 * | 8/2008 | Berthet et al. | ..... | 439/66 |
| 7,597,588 | B1 | 10/2009 | Hyzin et al. | ..... | 439/578 |

FOREIGN PATENT DOCUMENTS

| | | | |
|---|---|---|---|
| DE | 44 39 852 | A1 | 5/1996 |
| WO | WO 2007/062845 | A1 | 6/2007 |

* cited by examiner

*Primary Examiner* — Hae Moon Hyeon
(74) *Attorney, Agent, or Firm* — Peter Van Winkle

(57) ABSTRACT

A connector system includes first and second mateable connectors (12, 14) with coaxial contacts, wherein the first connector has movable center and outer contacts (20, 22) that are each biased forward by a separate spring (24, 26) to engage stationary contact pads (34, 36) of the mating second connector. A stationary tubular insulator (100) surrounds much of the movable center contact, and a stationary sheet metal shield (102) lies around the tubular insulator and within the outer contact. The front end of the movable outer contact forms an internal flange (80) with a hole (84) that allows the front end of the movable center contact to pass through. The shield front-end has an internal flange (112) that lies between the front end of the tubular insulator and the movable outer contact internal flange, to maintain a constant impedance through out the first connector.

9 Claims, 1 Drawing Sheet

DUAL SPRING PROBE COAXIAL CONTACT SYSTEM

BACKGROUND OF THE INVENTION

Connectors often includes coaxial contacts to carry high frequency signals (e.g. over 1 MHz). One design uses long pin-and-socket contacts to assure good electrical engagement between the mating contacts. This kind of contact arrangement requires that one contact be inserted deeply within the other, which is a disadvantage in many applications. Also, the insertion of one contact deeply into another can alter the characteristic impedance along the contacts and result in losses.

A contact arrangement for connector that include at least one set of coaxial contacts, which enabled mating with only a short distance of movement of one contact into the other one, and which enabled close control of the characteristic impedance along the connector, would be of value.

SUMMARY OF THE INVENTION

In accordance with one embodiment of the invention, a coaxial connector system is provided which enables first and second connectors with coaxial contacts to mate with only a short insertion distance of one connector into the other, and which enables the close control of connector characteristic impedance along the connector length to minimize losses. A first connector has center and outer movable contacts, and the second connector has stationary center and outer contacts in the form of contact pads. First and second helical compression springs are provided, one for each movable contact. The compression springs bias the movable contacts forwardly so they firmly engage the contact pads, with only a small distance of movement of one connector into the other.

The first connector includes a tubular insulator that surrounds the movable center contact. The first connector also has a sheet metal shield that surrounds the tubular insulator and that lies within the movable outer contact. The movable outer contact has a front end that includes an internal flange that lies forward of the tubular insulator. The sheet metal shield has an internal flange at its front end that lies against the front end of the tubular insulator and behind the internal flange of the outer contact. The sheet metal shield provides a more constant impedance to reduce losses.

The novel features of the invention are set forth with particularity in the appended claims. The invention will be best understood from the following description when read in conjunction with the accompanying drawings.

DESCRIPTION OF THE PREFERRED EMBODIMENT

Figure 2:
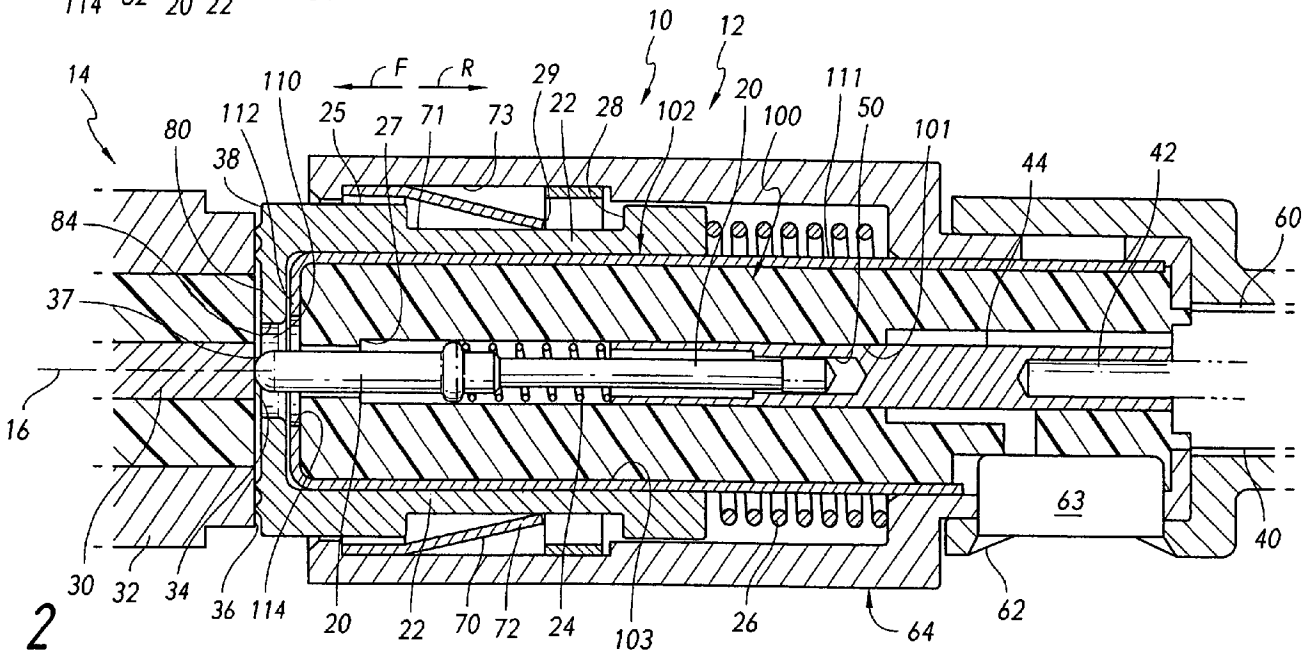
FIG. 2 is a sectional view of a connector system that includes the first connector of FIG. 1 and a second mating connector, with the connectors shown fully mated.

FIG. 2 shows a connector system 10 that includes first and second coaxial connectors 12, 14 that lie on an axis 16 that extends in front F and rear R directions. Each connector is symmetric about the axis. The first connector 12 includes a movable center or inner contact 20, and a movable outer contact 22. The inner and outer contacts are biased forwardly by separate helical wire compression springs 24, 26. Both compression springs extend around the axis and thereby avoid a sudden change in characteristic impedance. A center stop 27 limits forward movement of the inner contact, and an outer stop 28 that can abut a clip tab rear end 29, limits outer contact forward movement. The second connector 14 has stationary inner and outer contacts 30, 32 whose rear ends form contact pads 34, 36. The contact pads 34, 36 are preferably flush with each other, and the moveable contact front ends are flush when their front end 37, 38 both engage the contact pads. FIG. 2 shows the two connectors 12, 14 fully engaged, with each movable contact 20, 22 engaging a corresponding stationary contact pad 34, 36.

Coaxial contacts have characteristic impedances, with a 50 ohm impedance being the most common. Losses are minimized by constructing all sections of the connectors with characteristic impedances that are close to 50 ohms.

Figure 1:
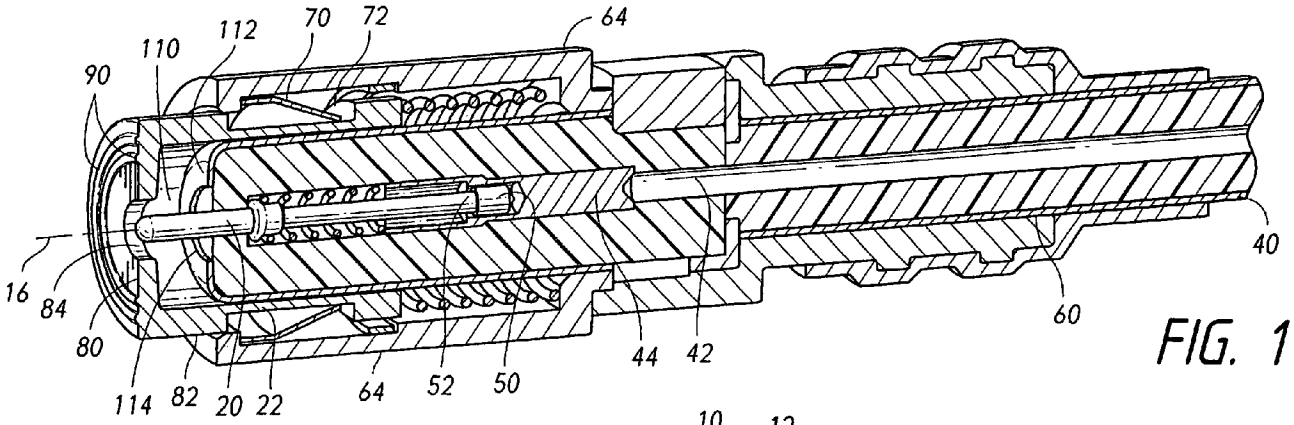
FIG. 1 is an isometric sectional view of a first connector of a connector system of the invention.

As shown in FIGS. 1 and 2, the first connector is connected to a coaxial cable 40, with the center conductor 42 of the cable fixed to a rod 44 that has a passage 50 in which the rear end 52 of the movable contact slides axially. The outer cable conductor 60 of the cable is soldered at 62 through a hole 63 to an outer conductive shell 64. The movable outer contact 22 slides within the outer shell and is continuously connected to the outer shell by a ground clip 70 that lies in an outer contact slot 71 and a shell slot 73. The clip has tabs 72 that extend at an incline to the axis and that press against the moveable contact. The cable outer conductor is usually grounded and electrically grounds the outer movable contact.

The movable outer contact 22 has a sleeve portion 25 with a front end with an internal flange 80, that is, with a flange that extends radially inwardly towards the axis 16 from the front cylindrical portion 82 of the outer movable contact. The internal flange extends by a majority of a full circle (i.e. over 180°) about the axis and preferably extends by a full circle (360°) about the axis. The internal flange 80 has an aperture 84 through which the movable inner contact 20 can readily pass without engaging the outer contact, so the movable inner contact can engage the center contact pad 34 of the second or mating connector 14.

The first and second connectors 12, 14 are usually parts of a larger connector arrangement that may include additional connectors of the coaxial or noncoaxial type, such as shown in applicants' U.S. Pat. No. 7,597,588. However, it is also possible for the first and second connectors to be the only connectors, and to be held together by bayonet threads, a latch, etc. In either case, the use of movable contacts that engage contacts pads of a mateable connector enables mating to occur with one connector moving a minimal distance into the other to fully mate thereto. The present invention uses a single movable outer contact to increase reliability and maintain a more constant characteristic impedance for lower losses.

The internal flange 80 at the front end of the movable outer contact 22 is provided with a pair of forward-projecting ridges 90. The ridges engage the stationary outer pad over an area not more than 10% of the area of the inner flange. The ridges concentrate forces applied by the movable outer contact to the outer contact pad 36 to produce a low resistance engagement. Actually, applicant prefers to interrupt the ridges with small slots.

The first connector includes a tubular insulator 100 that has walls forming a central passage 101 that surrounds the moveable inner contact 20 and that lies within a passage 103 of the movable outer contact 22. A stationary conductive shield 102 that is preferably formed from deep drawn sheet metal, surrounds the tubular insulator 100. The use of a thin (e.g. 0.01 inch or 0.25 mm) shield of sheet metal minimizes cost and size. The shield is electrically connected to the movable outer contact 22 in a number of ways, with one being a solder connection at 62 between the outer shell 64 and the shield and another one being the connection between the clip 70 and the shell. The shield 102 maintains a constant characteristic impedance, which is usually preferred to be 50 ohms. At the front end of the first connector there is an air gap 110 where the movable center contact projects forward of the insulator. Air has a lower permittivity than the insulative material of the tubular insulator. The shield is constructed with a tubular portion 111 and with an internal flange 112 forming an aperture 114, and that results in a smaller radial distance between the movable center and outer contacts at the air gap to counter the lower permittivity at the air gap. The internal flange 80 of the movable outer contact also helps to maintain a 50 ohm characteristic impedance along the air gap 110.

Thus, the invention provides a connector system that includes first and second coaxial connectors wherein one connector has movable inner and outer contacts and the other connector has stationary inner and outer contact pads, and where the first connector is constructed to maintain a largely constant characteristic impedance throughout its length for minimum losses. The movable inner and outer contacts are preferably each formed by a single contact that is biased forward by a separate helical spring that is centered on the connector axis. The first connector has a tubular insulator lying between the movable inner and outer contacts, and has a grounded sheet metal shield around the tubular insulator. The shield has an internal flange at its front end that lies against the front end of the insulator. The movable outer contact has an internal flange at its front end, the internal flanges of the shield and movable contact having apertures through which the movable center contacts can pass without touching the shield or outer contact flange.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector system comprising:

first and second coaxial connectors with respective front and rear ends that can be moved together;

said first connector has an axis (16) that extends in front and rear directions, said first connector has moveable center and outer contacts (20, 22) and has spring means (24, 26) that bias said moveable contacts forwardly, and said first connector has a stationary tubular insulator (100) that lies between said center and outer moveable contacts;

said first connector has a sheet metal shield (102) with a tubular portion (111) that lies around said tubular insulator and within said moveable outer contact, said sheet metal shield having a front end forming an internal flange (112) that lies at a front end of said tubular portion, said internal flange of said sheet metal shield having a center aperture (114) aligned with said moveable center contact (20) and larger than a front end (37) of said moveable center contact so said moveable center contact can project forwardly through said center aperture;

said second connector lies forward of said first connector, and said second connector includes inner and outer contacts (30, 32) respectively, positioned to engage said moveable center and outer contacts of said first connector when said first and second connectors are moved together.

2. The connector described in claim 1, wherein:

said moveable outer contact has a sleeve portion (25) that extends around said shield tubular portion, and said moveable outer contact has a front end with an internal flange (80) that lies forward of said shield internal flange and that has an outer contact hole (84) that lies on said axis and that is larger than a front end of said moveable center contact so said moveable center contact also can project forwardly through said outer contact hole.

3. The connector described in claim 2 including:

an electrically conductive outer shell (64) with a front portion that surrounds said moveable outer contact sleeve portion (25) and that is engaged with said outer contact sleeve portion, said outer shell having a rear portion that is joined in a solder joint (62) to said shield tubular portion;

said outer shell has a hole (63) that provides access to said solder joint.

4. A connector system comprising:

first and second coaxial connectors (12, 14) that each lies on an axis (16) extending in forward and rearward directions, said connectors being moveable together to connect them;

said second coaxial connector has a stationary inner contact pad (34) and a stationary outer contact pad (36) that each face primarily rearward;

said first coaxial connector has a moveable center contact (20) and a center contact spring (24) that biases said moveable center contact forwardly, and a center stop (27) that limits center contact forward movement;

said first coaxial connector has a moveable outer contact (22) that extends around said axis and an outer contact spring (26) that biases said moveable outer contact forwardly, and has an outer stop (28) that limits outer contact forward movement;

said moveable center contact has a front end (37), and said moveable outer contact has a front end (38) with an inward flange (80) that has walls forming an aperture (84) aligned with said moveable center contact to allow said moveable center contact to pass therethrough.

5. The connector system described in claim 4, wherein:

said inward flange (80) that lies at a front end of said moveable outer contact, has at least one forward-projecting ridge (90) that engages said stationary outer contact pad.

6. A connector system comprising:

first and second coaxial connectors (12, 14) that each lies on an axis (16) extending in forward and rearward directions, said connectors being moveable together to connect them;

said second coaxial connector has a stationary inner contact pad (34) and a stationary outer contact pad (36) that each face primarily rearward;

said first coaxial connector has a moveable center contact (20) and a center contact spring (24) that biases said moveable center contact forwardly, and a center stop (27) that limits center contact forward movement;

said first coaxial connector has a moveable outer contact (22) that extends around said axis and an outer contact spring (26) that biases said moveable outer contact forwardly, and has an outer stop (28) that limits outer contact forward movement;

said first coaxial connector has an outer shell (64) lying around said moveable outer contact (22);

said moveable outer contact and said outer shell each have slots (71, 73) that open to each other, and including a conductive ground clip (70) that lies in said slots and that contacts said outer shell, said ground clip having at least one tab (72) that extends at a radially inward incline to said axis and that bears against said moveable outer contact.

7. The connector describe in claim 6, wherein:

said tab forms said outer stop that limits outer contact forward movement.

8. A connector system comprising:

first and second coaxial connectors (12, 14) that each lies on an axis (16) extending in forward and rearward directions, said connectors being moveable together to connect them;

said second coaxial connector has a stationary inner contact pad (34) and a stationary outer contact pad (36) that each face primarily rearward;

said first coaxial connector has a moveable center contact (20) and a center contact spring (24) that biases said moveable center contact forwardly, and a center stop (27) that limits center contact forward movement;

said first coaxial connector has a moveable outer contact (22) that extends around said axis and an outer contact spring (26) that biases said moveable outer contact forwardly, and has an outer stop (28) that limits outer contact forward movement;

said first connector includes a tubular insulator (100) with a center passage (101), with said moveable center contact lying primarily in said center passage and with a front end of said moveable center contact projecting forward beyond said tubular insulator;

said moveable outer contact has an inner passage (103) that receives said tubular insulator, and said moveable outer contact has a front end with an inner flange (80) that forms a front passage (84) that is of smaller diameter than said inner passage, with said moveable center contact being moveable through said front passage.

9. A connector system comprising:

first and second coaxial connectors (12, 14) that each lies on an axis (16) extending in forward and rearward directions, said connectors being moveable together to connect them;

said second coaxial connector has a stationary inner contact pad (34) and a stationary outer contact pad (36) that each face primarily rearward;

said first coaxial connector has a moveable center contact (20) and a center contact spring (24) that biases said moveable center contact forwardly, and a center stop (27) that limits center contact forward movement;

said first coaxial connector has a moveable outer contact (22) that extends around said axis and an outer contact spring (26) that biases said moveable outer contact forwardly, and has an outer stop (28) that limits outer contact forward movement;

said first connector includes a tubular insulator (100) with a center passage (101) that surrounds part of said moveable center contact with said moveable center contact projecting forward of said center passage; and including a nonmoveable conductive shield (102) that has a tubular portion that lies between said tubular insulator and said moveable outer contact and that is electrically connected to said moveable outer contact;

said moveable outer contact having a front internal flange (80) that lies forward of said tubular insulator, with a center aperture (84) that is larger than a front end of said moveable center contact, and said conductive shield has an internal flange (112) that lies between a forward end of said tubular insulator and said front internal flange of said outer moveable outer contact.

* * * * *